United States Patent [19]

Knudson

[11] Patent Number: 4,726,107

[45] Date of Patent: Feb. 23, 1988

[54] SEAMING APPARATUS

[76] Inventor: Gary A. Knudson, 17356 W. 57th Ave., Golden, Colo. 80401

[21] Appl. No.: 70,352

[22] Filed: Jul. 6, 1987

[51] Int. Cl.[4] ..... B23P 11/00

[52] U.S. Cl. ..... 29/243.5

[58] Field of Search ..... 29/243.5, 293.58; 72/51, 52, 210, 248; 51/178; 125/14; 254/134.5

[56] References Cited

U.S. PATENT DOCUMENTS

| | | | |
|---|---|---|---|
| 2,171,297 | 8/1939 | Zahner et al. | 29/243.5 |
| 3,662,699 | 5/1972 | Horn et al. | 29/243.5 |
| 3,771,482 | 11/1973 | Thompson | 29/243.5 |
| 4,324,031 | 4/1982 | Isenhoff | 29/243.5 |

*Primary Examiner*—Robert C. Watson

*Attorney, Agent, or Firm*—Fields, Lewis, Pittenger & Rost

[57] ABSTRACT

Seaming apparatus for joining the adjacent side edge portions of two adjacent panels to provide a continuous seam is disclosed. The apparatus includes a support base having a main base portion and a movable base portion. The movable base portion is pivotally connected to the main base portion for pivotal movement about an axis between a first position and a second position. Sets of opposed motor driven seaming rollers are mounted on the base with one roller of each set being rotatably mounted on the movable base portion and the other roller of each set rotatably mounted on the main base portion. The rollers of each set are oppositely disposed and have peripheral surfaces arranged to engage the adjacent side edge portions of the adjacent panels. A drive train driven by a motor and including a drive gear for each driven roller is provided for rotating the driven rollers to move the apparatus along the adjacent side edge portions. Actuating means is mounted off one side of the movable base portion for pivotally moving the movable base toward and away from the main base between the first position and the second position. When in the first position, the axes of the rollers of each set of driven rollers will be substantially parallel. When in the second position, these axes will form an included angle of less than 30 degrees which maintains the drive gears of each set of rollers in meshing engagement. One seamer has four sets and the other three sets of seaming rollers. The latter form uses a cam surface to direct one of the rollers of one set in a selected path to move the roller to a horizontal position and to clear the formed seam.

17 Claims, 25 Drawing Figures

164
171
10
171
48
52
57
56
48
166
170
170
168
61
55
46
29
2
58
44
36
30
60
A
54
64
65
63
50
32
186
56
P
40
62
57
184
58
12
2
50
182
12
64
65
60
B 48
52
166
164
168
P
54
44
P1
56
98
74
101
87
72
78
5
76
5
97
P2
C
10
6
6
186
103
118
50
68
184
60
10
105
70
28
10
40
182
P3
64
12
27
87
88
122
12

SEAMING APPARATUS

TECHNICAL FIELD

This invention relates to a novel and improved seaming apparatus for joining the side edge portions of adjacent panels together by forming a longitudinally continuous connecting seam.

BACKGROUND ART

U.S. Pat. No. 3,875,642 discloses a seaming apparatus utilizing three sets of rollers that is particularly suited for forming continuous seam structure along the side edges of panels having vertical side wall portions arranged parallel to one another and side connecting flanges that extend laterally out from the upper edge of vertical side wall portions.

U.S. Pat. No. 4,470,186 discloses a reversible seaming apparatus including a supporting frame on which there are rotatably mounted two sets of opposed seaming rollers, the sets being spaced from one another along the apparatus to successively engage and thereby seam the side edge portions of two adjacent panels together. One roller of each set is movable toward and away from the other roller of each set between a closely spaced seaming position and a laterally separated release position. A drive motor and drive train between the motor and rollers provide a direct positive drive for each roller when the rollers are in the seaming position. When the rollers are in their spread release position, the seamer may be lifted off any point along the adjacent edges which are being seamed. The ability to remove the seamer from any point along the edges is highly advantageous. However, this seamer disengages the rollers' drive gears when it is moved to its release position. Accordingly, the drive gears have to be reengaged when it is desired to return the seamer to its operating position. The gears may have difficulty reengaging if their teeth meet head on (i.e. end to end).

DISCLOSURE OF INVENTION

The present invention solves the aforementioned problem of gear reengagement by providing a seaming apparatus which can be placed down upon and/or lifted off any point along the seam being formed without having to disengage the seamer's drive gears.

The seaming apparatus includes at least two sets of opposed seaming rollers which are rotatably mounted on a base including a first base portion and a second base portion. The peripheral surface portions of the opposed rollers of each set are arranged to simultaneously bear against differently facing surfaces of the side edge portions being seamed. Each set of rollers is spaced from another set along the base so as to engage and track on the adjacent side edge portions and thereby form the continuous connecting seam as the rollers are moved along the side edge portions. One roller of each set is supported on the first base portion with the other roller of each set being supported on the second base portion. The first and second base portions are joined for pivotal movement toward and away from one another between a first position for seaming and a second spread position for lifting the seaming apparatus off the seam being formed. The seaming apparatus also includes actuating means for moving the base portions between the first and second positions. The apparatus further includes drive means for simultaneously rotating the rollers of at least one set of opposed seaming rollers to move the seaming apparatus along the adjacent side edge portions of the adjacent panels. The drive means includes a drive gear for each roller to be driven thereby. The drive gears of each set are maintained in a meshing relationship with each other even when the base portions are in the second position and during pivotal movement between the first and second positions.

One seamer disclosed movable in one direction has four sets of opposed seaming rollers to form one type of seam. Another seamer disclosed movable in either direction has three sets of opposed seaming rollers to form another type of seam. In the latter seamer only two of the three sets are used to form the seam. A pivoting cam surface is used to move one of the rollers which is generally horizontally oriented during seaming in a selected path to clear the formed seam.

BRIEF DESCRIPTION OF DRAWINGS

Details of this invention will be described in connection with the accompanying drawings, in which.

DETAILED DESCRIPTION

Figure 1:
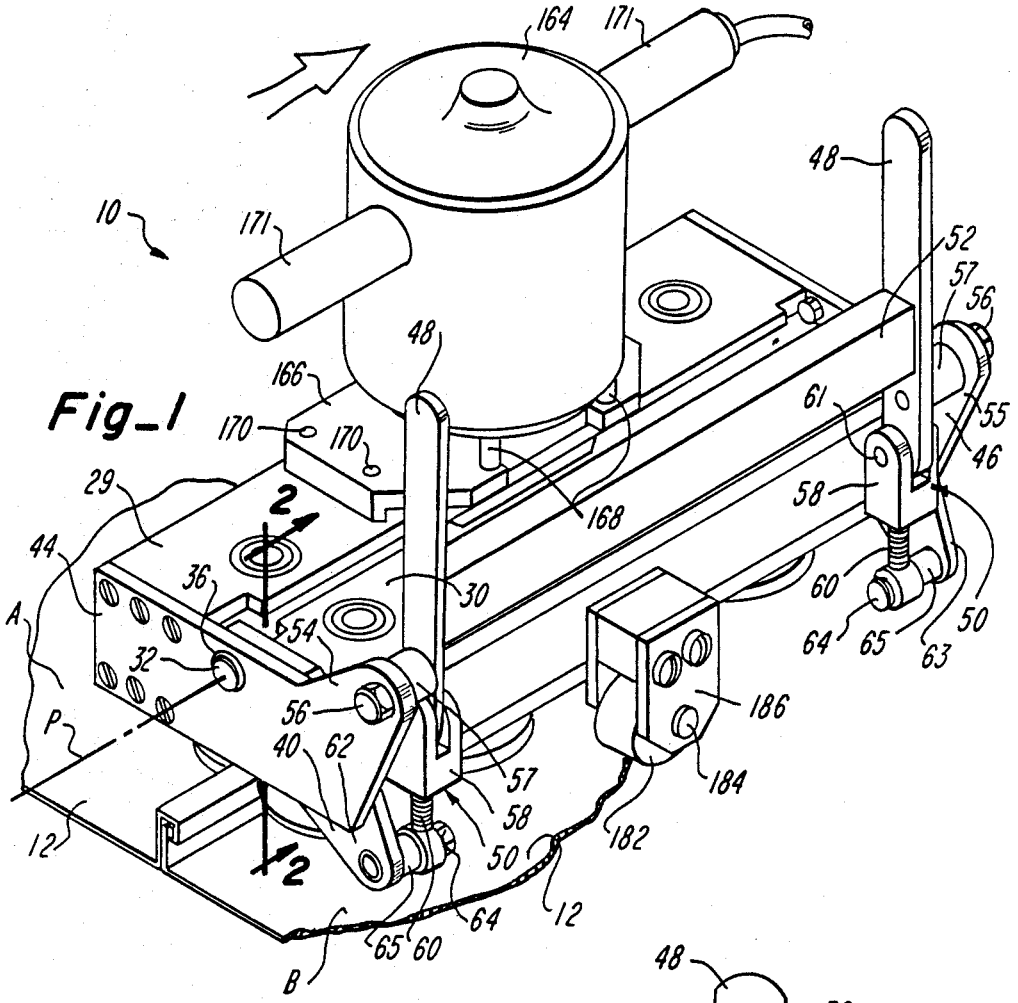
FIG. 1 is a perspective view of a seaming apparatus embodying features of the present invention mounted in an operating position on the adjacent side edge portions of two adjacent building panels.

Referring now to FIGS. 1–16, a self-propelled seaming apparatus 10 is shown for seaming together the nested side edge portions of two adjacent building panels A and B. Seaming takes place as seaming apparatus 10 moves from the left to the right as indicated by the arrow in FIG. 1. Panels A and B are of the same construction and each has an intermediate portion 12. Panel B has a raised inturned side edge portion extending up from its intermediate portion 12 which includes an upstanding side section 14 and a lateral flange section 15 of double thickness to provide an inturned laterally extending male joint portion. Panel A has a raised side edge portion extending up from its intermediate portion 12 and includes an upstanding side section 16, a lateral flange section 17 and a downturned terminal section 18 forming an inverted, open channel to provide an outturned female joint portion. The male joint portion is inserted into and is nested within the female joint portion prior to seaming.

Seaming apparatus 10, generally stated, includes a supporting means or base 20 together with four sets of opposed seaming rollers, the first set comprising seaming rollers 21 and 22, the second set comprising seaming rollers 23 and 24, the third set comprising seaming rollers 25 and 26, and the fourth set comprising seaming rollers 27 and 28. The sets are rotatably mounted on base 20 and spaced from one another along the base.

As shown, the unseamed channel provided by the nested side edge portions of adjacent building panels A and B is first engaged by the first or leading set of rollers 21 and 22 in a first bending operation and then successively engaged by the second, third and fourth sets of rollers, respectively, in second, third and fourth bending operations.

Figure 6:
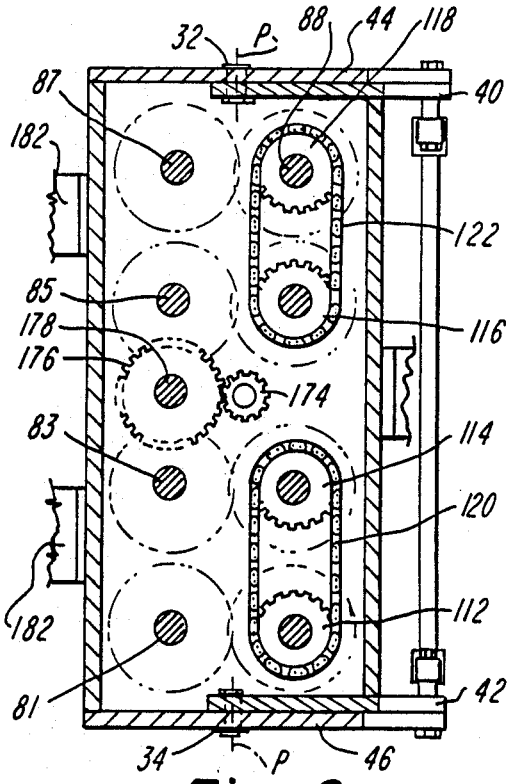
FIG. 6 is a cross sectional view taken along the lines 6—6 of FIG. 2.
Figure 5:
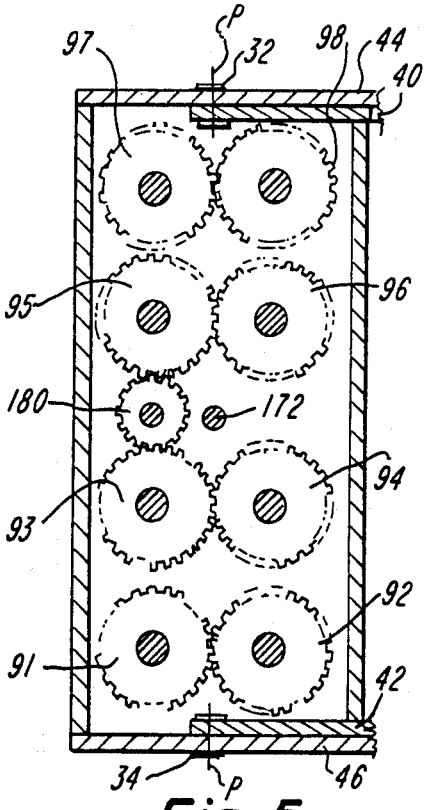
FIG. 5 is a cross sectional view taken along the lines 5—5 of FIG. 2.

Seaming rollers 21, 23, 25 and 27 are rotatably mounted on an inboard or main base portion 29 and rollers 22, 24, 26 and 28 are rotatably mounted on an outboard or movable base portion 30 that is pivotally movable with respect to main base portion 29. Base portion 30 is pivotally connected to main base portion 29 by two pivot pins 32 and 34 which are located at opposite ends of seaming apparatus 10 as best seen in FIGS. 5 and 6. Pins 32 and 34 are axially aligned along an axis P.

Pins 32 and 34 are rotatably mounted in bushings 36 and 38, respectively, which, in turn, are mounted in selectively located bores provided in end plates 40 and 42 of the movable base portion and end plates 44 and 46 of the main base portion. Preferably each pin is provided with a head which abuts up against an inwardly facing surface of its associated end plate. Preferably, each pin is secured in place by a conventional snap ring which is snapped into a groove provided on the end of the pin which extends out from the outwardly facing or exterior surface of its respective main base end plate. Collar-like spacers are also preferably mounted on each pin's shaft between the respective movable and main base end plates to prevent the plates from rubbing against each other during pivotal movement of movable base 30.

Movement of movable base portion 30 is provided by an actuating means or lift assembly which is mounted off the movable base's outer or outwardly facing side. The assembly includes right and left lever arms 48, right and left movable links 50 and a spacer bar 52 which rigidly connects arms 48. Since the mounting and operation of the right and left sets of arms 48 and associated links 50 is identical, only the left set will be described. The components of the right and left sets are also identically numbered since they function identically.

As illustrated, arm 48 has two pivot points P1 and P2. P1 is the pivotal connection between an intermediate section of arm 48 and an extension 54 of main base end plate 44. Extension 54 extends or projects outwardly and up at an angle from the top and outer side of the movable base as illustrated. The right lever arm is similarly attached to an extension 55 of end plate 46 which is identical to extension 54. P1 includes a pivoting bolt means 56 and a spacer 57 which respectively serve to pivotally connect and space arm 48 and extension 54.

P2 is the pivotal connection between the lower end of arm 48 and the upper end of movable link 50. Link 50 is in the form of a clevis 58 and a threaded rod end 60 having an eyelet. Rod end 60 threads into the clevis to enable the length of the link to be adjusted which enables the spacing between the adjacent surfaces of the rollers to be varied. This permits the seamer to accomodate panels of different gauge metal. P2 includes a pin 61 which pivotally connects arm 48 and clevis 58 together.

P3 is the pivotal connection between the eyelet of the threaded rod end and an extension 62 of movable base end plate 40. As illustrated, extension 62 extends or projects outwardly and down at an angle from the bottom and outer side of the movable base. End Plate 42 located on the opposite side of the movable base is provided with an identical extension 63. P3 includes a pivoting bolt means 64 and a spacer 65 which connect the eyelet of rod end 60 to extension 62 of the movable base end plate.

In the seaming position, lever arm 48 and associated link 50 are positioned end to end but at a slight over-center position with the lower end portion of arm 48 being positioned against a side plate 78 of the movable base at a contact point designated C. Pivots P1, P2 and P3 are arranged so that P2 is slightly in from a straight line passing through pivots P1 and P3. This over-center position serves to prevent P2 from moving outwardly away from side plate 78, and as such serves to lock the movable base portion against outward lateral movement so the movable base will not pop out of this position while seaming is taking place. Contact point C is located slightly below pivot P.

Figure 2:
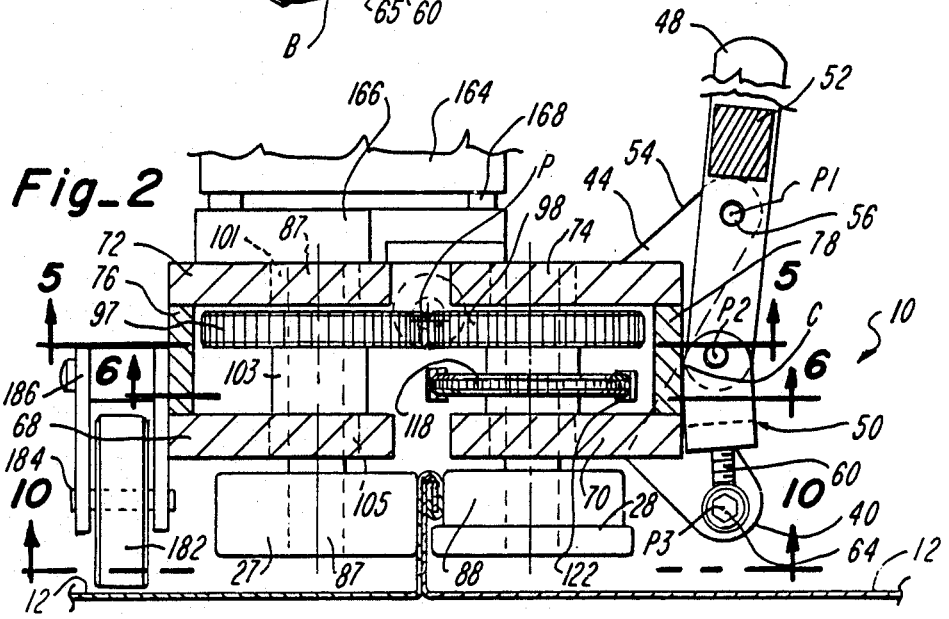
FIG. 2 is a cross sectional view taken along the lines 2—2 of FIG. 1.
Figure 3:
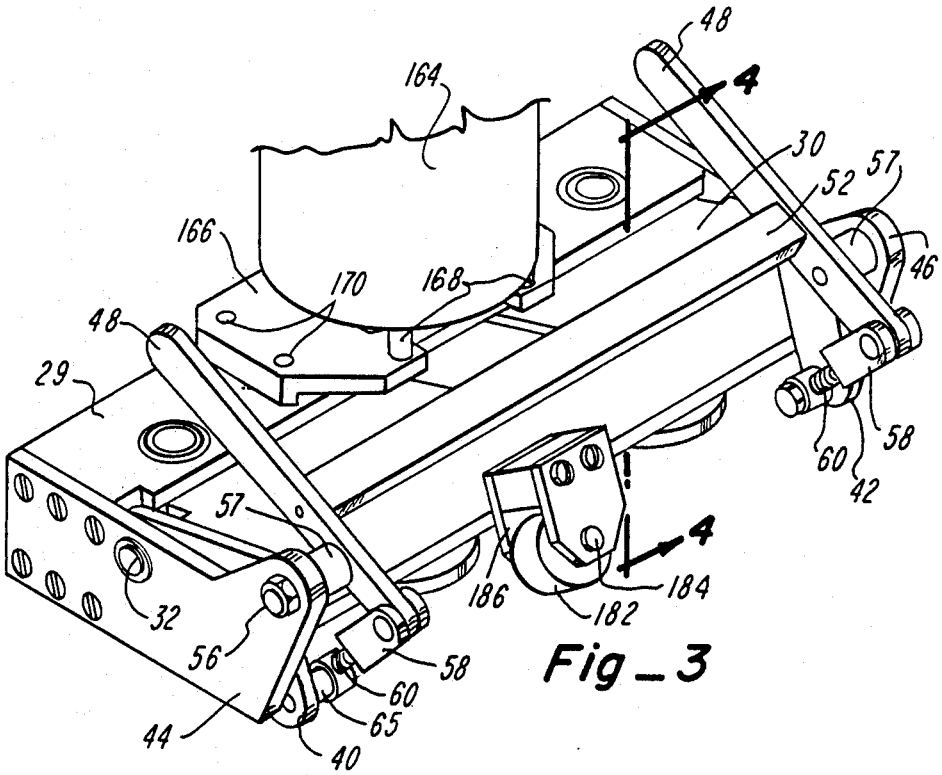
FIG. 3 is a perspective view of the seaming apparatus of FIG. 1 showing the apparatus in its spread position.
Figure 4:
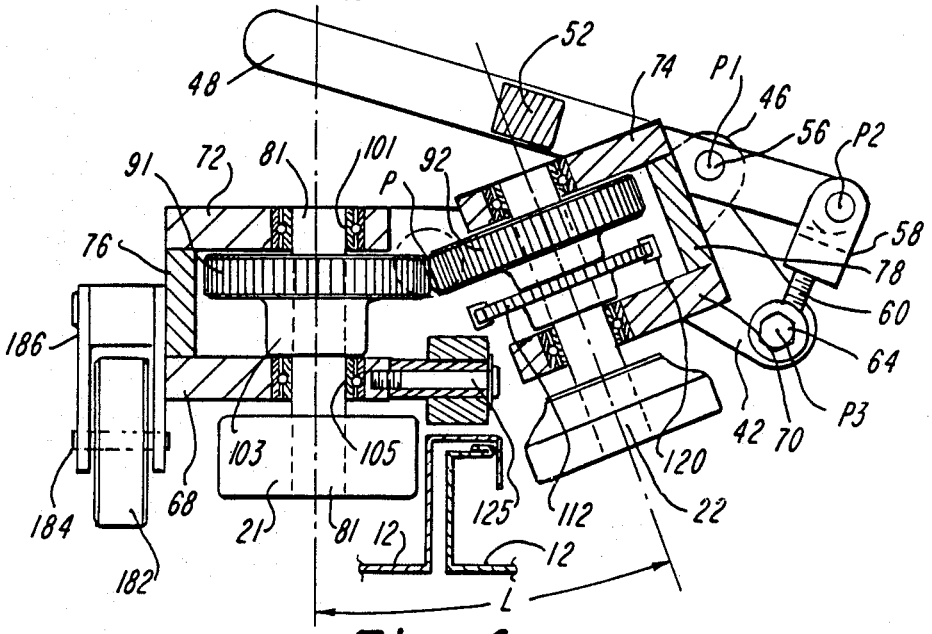
FIG. 4 is a cross sectional view taken along the lines 4—4 of FIG. 3.

The application of force to the lever arm assembly in a counterclockwise direction as viewed in FIG. 2 will move pivot P2 away from side plate 78 past the over-center position. As the lever arm continues to pivot about P2, links 50 will pull upwardly on extensions 62 and 63 of the movable base end plates, thereby raising the movable base to an open or spread position. As such, the movable base and associated rollers will have rotated through included angle L which is illustrated in FIG. 4. This movement is sufficient to enable the now spread rollers to clear the seam so the apparatus can be lifted off the seam. The angle shown is about 20 degrees and would usually not exceed 30 degrees.

Referring now to FIGS. 2 and 4, main base 29 and movable base 30, respectively, include bottom plates 68 and 70, top plates 72 and 74 and side plates 76 and 78. Seaming rollers 21, 23, 25 and 27 are rotatably mounted on main base 29 in the same manner. Rollers 21, 23, 25 and 27 are mounted on shafts 81, 83, 85 and 87, respectively, which, in turn, carry drive gears 91, 93, 95 and 97, respectively.

Since the mounting of rollers 21, 23, 25 and 27 is the same, only the mounting of roller 21 will be described. As illustrated in FIG. 4, the upper section of shaft 81 is affixed to the inside race of a bearing 101 with the outer race of the bearing mounted in top plate 72. Drive gear 91 is affixed to this upper shaft section with a key (not shown) in a key way (also not shown) provided in the shaft's upper section. Shaft 81's mid-section has a mid-spacer 103 mounted thereon which serves to space drive gear 91 from main base's bottom plate 68. Shaft 81 also has a lower mid-section affixed to the inside race of a bearing 105 with the outer race of the bearing mounted in bottom plate 68. The lowermost section of shaft 81 extends downwardly through and below bottom plate 68 and has drive roller 21 mounted thereon. Drive roller 21 is provided with an axially extending bore which receives shaft 81 and is conventionally secured thereto with a key (not shown) in a key way (also not shown) provided in shaft 81. The axially extending bore of roller 21 extends through the roller's bottom face and the bore is sized to receive a conventional washer and threaded bolt assembly (not shown) which threads into an internally threaded hole in the bottom of shaft 81 to rigidly secure the roller to the shaft.

The mounting of drive rollers 22, 24, 26 and 28 on pivotally movable base 30 is identical to that described above for drive rollers 21, 23, 25 and 27 with the exception that chain sprockets 112, 114, 116 and 118 are mounted on the respective shafts' mid-sections instead of mid-spacers 103. In FIG. 6, it can be seen that chain sprockets 112 and 114 are driven by roller chain 120 and that chain sprockets 116 and 118 are driven by a roller chain 122. Details of the complete drive train system for seamer 10 will be described in more detail below.

Figure 15:
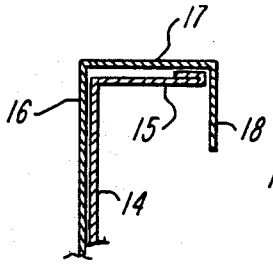
FIG. 15 is a cross sectional view of the unseamed inverted channel provided by the nested side edge portions of adjacent building panels.
Figure 16:
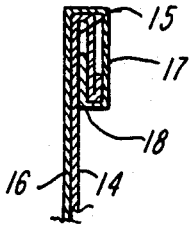
FIG. 16 is a cross sectional view of the seamed nested side edge portions.

FIGS. 10–14 illustrate the four sequential seaming operations provided by seamer 10 of the present invention. FIG. 15, as previously mentioned, illustrates the inturned side edge of panel B nested or disposed within the outturned side edge of panel A as they would appear prior to being seamed. FIG. 16 illustrates the nested side edge portions after having been seamed.

Figure 11:
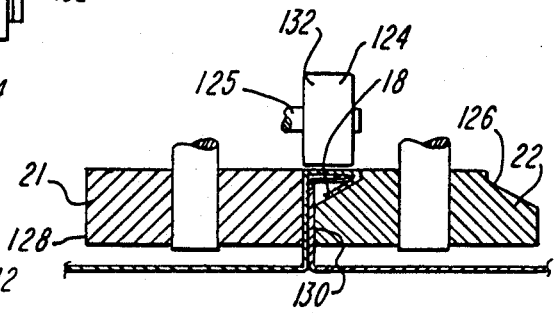
FIG. 11 is a fragmentary cross sectional view illustrating the first set of rollers forming the first bend.

Beginning with FIG. 11, drive rollers 21 and 22 and an auxiliary roller 124 (rotatably mounted on a shaft 125 which is bolted to bottom plate 68) are engaging the outwardly facing surfaces of sections 16, 18 and 17, respectively, and, as such, are bending terminal end section 18 inwardly approximately 45 degrees from its initial vertical downwardly oriented position (illustrated in FIG. 15). The 45 degree bend is made (as the seamer travels along the channel) by an upper beveled surface 126 of roller 22 which is beveled at approximately a 45 degree angle from the roller's top surface. The initial bending of terminal section 18 can also be made by closing or clamping the pivotally movable base portion 30 about the nested side edge portions (i.e., by moving base 30 from its spaced second position as illustrated in FIG. 4 to its first operating or seaming position illustrated in FIG. 11). This closing movement clamps the nested outturned and inturned side edges together and positions the respective peripheral surfaces of the rollers against the appropriate outwardly facing surfaces of the nested side edges so that the rollers will properly track on the nested side edges to provide the desired finished seam. Buckling of the nested side edges is prevented during the first seaming step by vertical surfaces 128 and 130 of rollers 21 and 22, respectively, and horizontal surface 132 of auxiliary roller 124.

Figure 12:
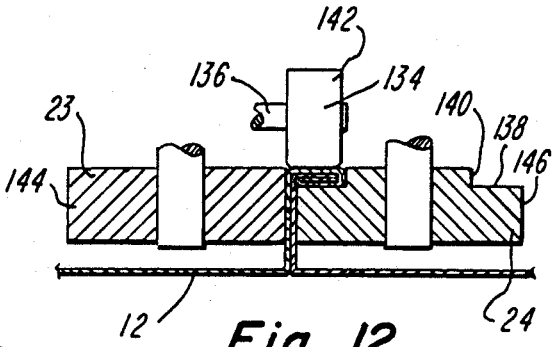
FIG. 12 is a a fragmentary cross sectional view illustrating the second set of rollers forming the second bend.

FIG. 12 illustrates the second forming operation provided by seamer 10 of the present invention. In this operation, rollers 23 and 24 and a second auxiliary roller 134 (rotatably mounted on a shaft 136 bolted to bottom plate 68) cooperate to bend the terminal end section 18 from its 45 degree position illustrated in FIG. 11 to its position illustrated in FIG. 12 wherein terminal section 18 is bent under and up against the inturned lateral flange section 15. To bend section 18 as illustrated, the upper section of roller 24 is provided with a generally horizontal peripheral surface 138 and a generally vertical, cylindrically shaped surface 140. These surfaces receive terminal section 18 and bend it tightly up against lateral flange section 15 which is restrained by a horizontal, cylindrically shaped surface 142 of auxiliary roller 134. The vertically upstanding sections 14 and 16 of the nested inturned and outturned side edges are prevented from buckling during the second forming operation by vertical peripheral surfaces 144 and 146 of rollers 23 and 24, respectively. Surfaces 142, 144 and 146 of the respective rollers also facilitate proper tracking of seamer 10 along the inverted channel provided by the nested side edges.

Figure 13:
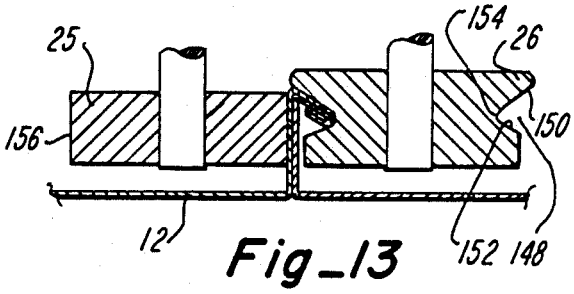
FIG. 13 is a fragmentary cross sectional view illustrating the third set of rollers forming the third bend.
Figure 10:
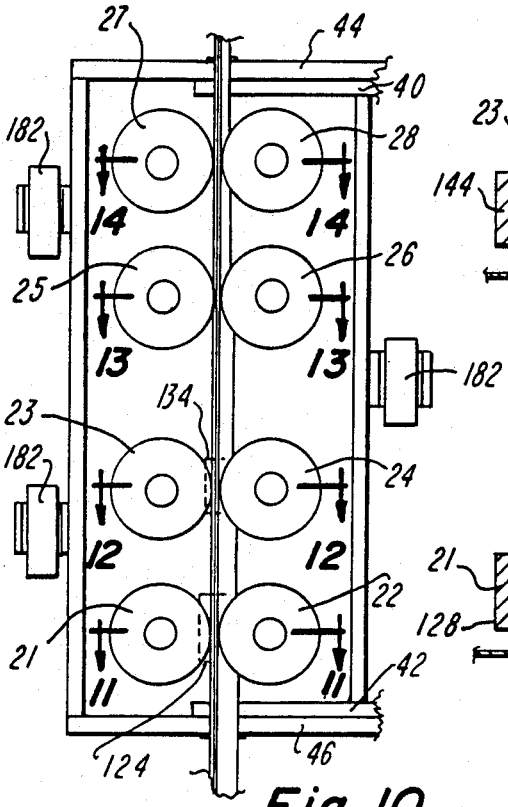
FIG. 10 is a cross sectional view taken along the lines 10—10 of FIG. 2.

FIG. 13 illustrates the third forming operation provided by seamer 10 of the present invention. The now joined flange-like parallel sections 15, 17 and 18 provided by the second forming operation are bent 45 degrees downwardly from their horizontal position illustrated in FIG. 12. To make this bend, seaming roller 26 is provided with a generally V-shaped peripheral groove 148 which is defined by opposed inclined side walls 150 and 152. Side wall 150 extends downwardly at an angle of approximately 45 degrees from the horizontal to provide the direct bending action. Side wall 152 which is angled approximately 30 degrees upwardly from the horizontal tends to prevent the joined flange like sections from separating from each other as they are being bent by side wall 150. The juncture of side walls 150 and 152 is also rounded to define a rounded root 154 which complements the rounded outwardly facing edge of the flange-like joined sections 15, 17 and 18. Rounded root 154 also serves to prevent the joined sections from separating during bending. Buckling of upstanding side walls 14 and 16 is restrained by a vertical peripheral surface 156 of cylindrically shaped roller 25.

Figure 14:
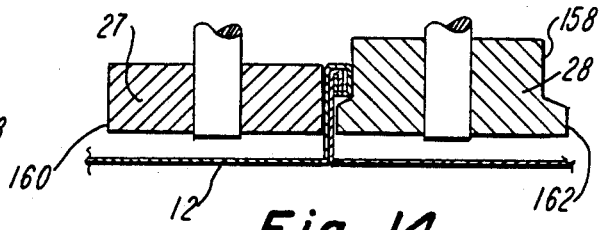
FIG. 14 is a fragmentary cross sectional view illustrating the fourth set of rollers forming the fourth bend.

FIG. 14 illustrates the final and fourth forming operation provided by seamer 10 of the present invention. Roller 28 is provided with a vertically oriented cylindrically shaped surface 158. Surface 158 receives the joined sections 15, 17 and 18 from the third forming operation and bends them tightly up against upstanding section 14 of the inturned side edge portion. This seam may be referred to as a double fold or double lock seam. Upstanding sections 14 and 16 are prevented from buckling during this bending action by the vertically oriented peripheral surface 160 of cylindrical roller 27. Roller 28 is also provided with a vertically oriented peripheral surface 162 at its lower end which serves to prevent upstanding walls 14 and 16 from buckling in this direction.

The drive for the above described seaming rollers includes an electric motor 164 mounted on a motor mount plate 166 with spacer pins 168 properly spacing the motor from the mounting plate 166. Motor mount 166 is bolted to main base portion 29 by conventional bolts 170 (see FIGS. 1 and 3). Motor 164 is provided with handles 171 and a drive shaft 172 (see FIG. 5) which has a main drive gear 174 mounted thereon at the shaft's lower end. Main drive gear 174 meshes with a main cluster gear 176 mounted on a cluster gear shaft 178 which is rotatably mounted on main base 29 with bearings and keys (not shown) in a conventional manner similar to that for mounting drive shafts 81–88. Cluster gear shaft 168 also has an auxiliary cluster gear 180 mounted on it which rotates with the main cluster gear. Auxiliary gear 180 meshes with gears 93 and 95 to transmit power to seaming rollers 23 and 25. In turn, gears 93 and 95 mesh respectively with gears 94 and 96 to transmit power to rollers 24 and 26, respectively. As previously mentioned, the drive shafts of rollers 24 and 26 are also provided with chain sprockets 114 and 116, respectively, which transmit power via roller chains 120 and 122 to chain sprockets 112 and 118, respectively, and thus seaming rollers 22 and 28, respectively (see FIG. 7). Power is further transmitted by drive gears 92 and 98 of rollers 22 and 28 which mesh respectively with drive gears 91 and 97. Drive gears 91 and 97, in turn, transmit power to seaming rollers 21 and 27.

An important aspect of the present invention is directed to maintaining the drive gears of each set of seaming rollers in constant meshing engagement with each other, including not only when movable base 30 is in its first operating position, but also when its in its second, spread position and also when pivotally moving between the first and second stations.

Figure 7:
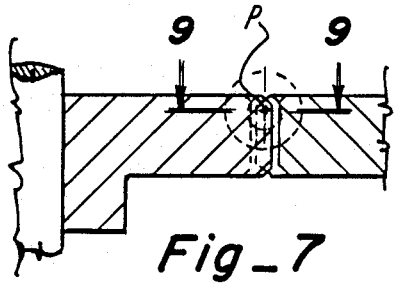
FIG. 7 is a fragmentary sectional view of two meshing drive gears showing the point at which axis P passes through the meshing teeth of the respective drive gears when the drive gears are in an operative seaming position.
Figure 9:
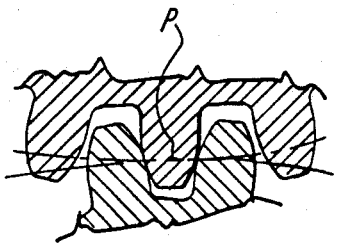
FIG. 9 is a fragmentary cross sectional view taken along the lines 9—9 of FIG. 7.
Figure 8:
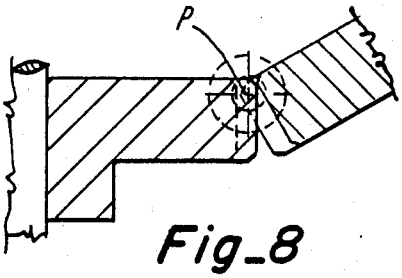
FIG. 8 is a fragmentary sectional view of the rollers of FIG. 7 showing the drive gears as they appear when the apparatus is in its spread position.

Constant gear engagement in accordance with the present invention is provided by selectively locating the axially aligned hinge pins 32 and 34 in selectively located holes in the main and movable base end plates so that the hinge pin's imaginary axis P passes through the meshing teeth of each set of roller drive gears at a location near the upper facing horizontal surface of the drive gears. This location is best illustrated in FIGS. 7–9. FIG. 7 illustrates the gear's meshing engagement in the seamer's first or operating position. Axis P is located about ⅛ inch below the upper surface of the gears. FIG. 8 illustrates the gear's meshing engagement in the second or spread position. It can be seen in this position that the drive gear for the roller mounted on the movable base has been pivotally moved upwardly about 20 degrees from the horizontal about axis P. A 20 degree movement will generally provide enough space between the rollers of each set to permit the rollers to be placed down on and removed from either the unseamed inverted channel provided by the nested side edge portions or the formed continuous seam at any point along the channel or seam. Greater angles may be necessary depending on the specific shape of the nested side edge portions. The upper limit at which meshing engagement can generally be maintained will be about 90 degrees for gears having conventional teeth with standard pressured angles which generally range between about 14.5 and 30 degrees.

FIG. 9 is a cross sectional top view of the meshing gears taken along lines 9—9 of FIG. 7. The dotted lines represent the meshing gears' respective pitch diameters. The gears are located and spaced from one another so that axis P preferably passes through the point at which the gears' teeth contact one another which preferably is at each gear's pitch point.

Seaming apparatus 10 is also provided with three freely rotating skate wheels 182, two of which are mounted to main base 29 with the remaining skate wheel mounted to movable base 30. Each skate wheel is mounted on an axle 184 which is mounted for rotational movement in a bracket 186. Each bracket 186 is conventionally bolted to its respective base portion at the locations illustrated in the drawings. The skate wheels properly space the seaming apparatus from the respective surfaces of adjacent panels A and B to facilitate proper tracking of the seamer along the inverted channel provided by the nested side edge portions of the panels.

OPERATION

Seaming with seamer 10 of the present invention can be initiated at either the unseamed end of the inverted channel or at any point along a seamed channel where seaming has been stopped or interrupted. If seaming is to begin at the unseamed end of an inverted channel, pivotally movable base 30 is preferably first moved or opened to its second or spaced position. This allows the first set of rollers (i.e. rollers 21 and 22) to be positioned over the end of the channel. Movable base 30 is then moved to its first or operating position which causes rollers 21 and 22 to clampingly engage oppositely facing surfaces of the channel and thereby bend the channel's terminal section 18 inwardly approximately 45 degrees as illustrated in FIG. 11. Motor 164 is then started causing rollers 21 and 22 to rotate and begin moving along the channel. The second, third and fourth sets of rollers will then successively engage and bend the channel as previously described and illustrated in FIGS. 12–14. It is important that the second, third and fourth sets of rollers, particularly the third and fourth sets, not be placed on the unseamed channel prior to seaming. The bends made by these rollers, particularly the third and fourth set of rollers, cannot be directly made from the unseamed channel illustrated in FIG. 15.

A similar starting procedure is to be followed if seaming is to be reinitiated at a point along the channel where it has been previously stopped or interrupted. When starting at such a point, all rollers including those of the first set should preferably be located on previously seamed portions of the channel. This will facilitate proper tracking of the rollers on the seam when the motor is started and will also serve to provide a smooth seam at the location where seaming was previously stopped, thereby making it difficult to tell where seaming was previously stopped.

FIGS. 17–25 illustrate another form of seaming apparatus 310 that is reversible or bi-directional. Reversible or bi-directional means that seamer 310 will operate in either direction along the inverted channel provided by the nested side edge portions.

Generally stated, seaming apparatus 310 includes a supporting means or base 320 together with three sets of opposed seaming rollers. The first set of rollers 321 and 322 and the second set of rollers 323 and 324 are identical to each other. The third or center set of rollers 325 and 326 is located between the first and second set of rollers.

Since seamer 310 will operate when moved in either direction, the terms "leading" and "trailing" as applied to the rollers will depend on the direction of movement of the apparatus. Accordingly, it will be appreciated that either the first or second set of rollers can serve as the leading set of rollers depending on the seamer's direction of movement along the nested side edge portions.

Figure 19:
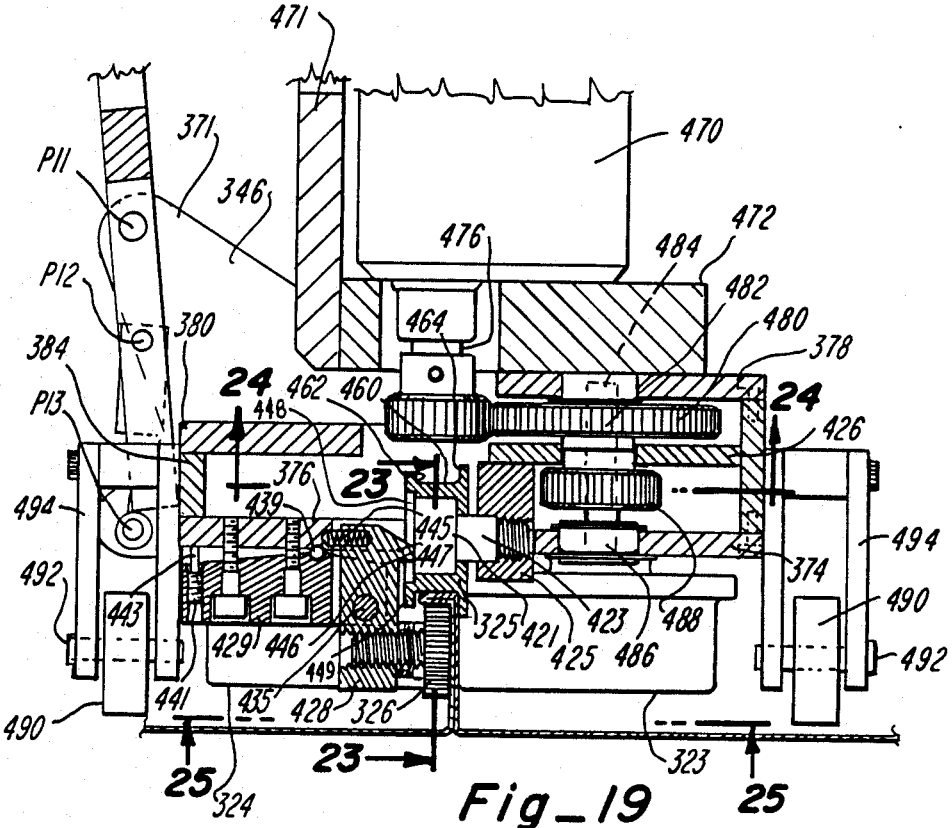
FIG. 19 is a cross sectional view taken along the lines 19—19 of FIG. 17 with two adjacent building panels being shown as fully seamed together.
Figure 21:
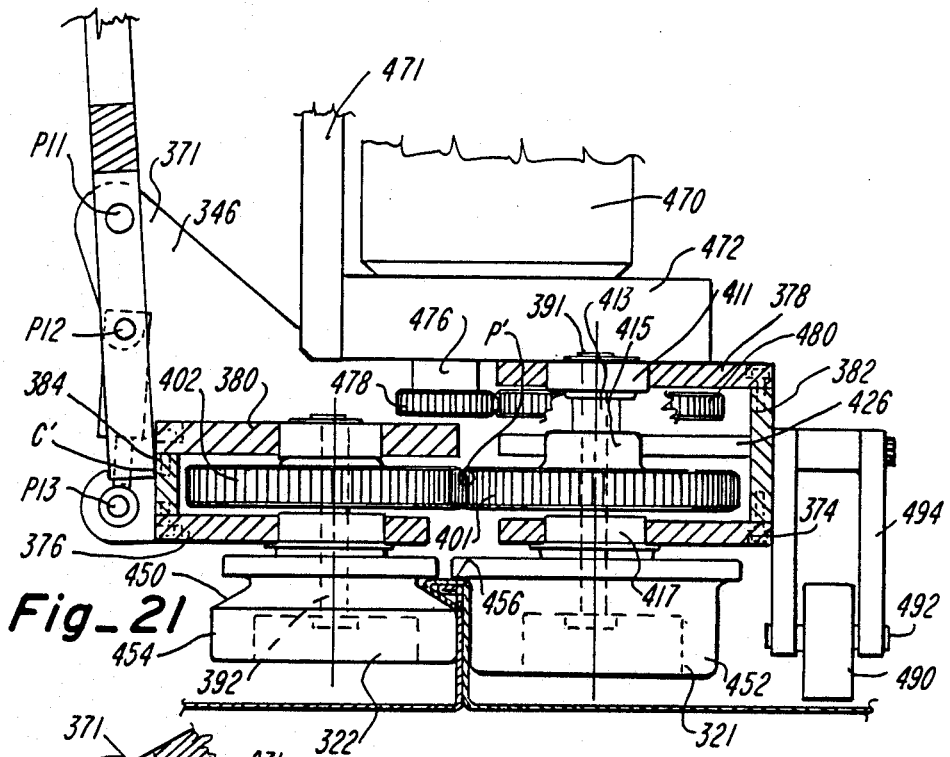
FIG. 21 is is a cross sectional view taken along the lines 21—21 of FIG. 17 with the building panels shown as partially seamed.

When the first set of rollers is the leading set, rollers 321 and 322 will engage the nested side edge portions in a first bending operation which is illustrated in FIG. 21. The bent seam provided thereby is then engaged by the third or center set of rollers in a second and final bending operation to provide the finished seam which is illustrated in FIG. 19. The second trailing set of rollers then receives the finished seam provided by the center set. The trailing set does not perform a bending operation on the seam. It does, however, track on the finished seam which thereby aids in propelling the seamer along the channel.

Figure 24:
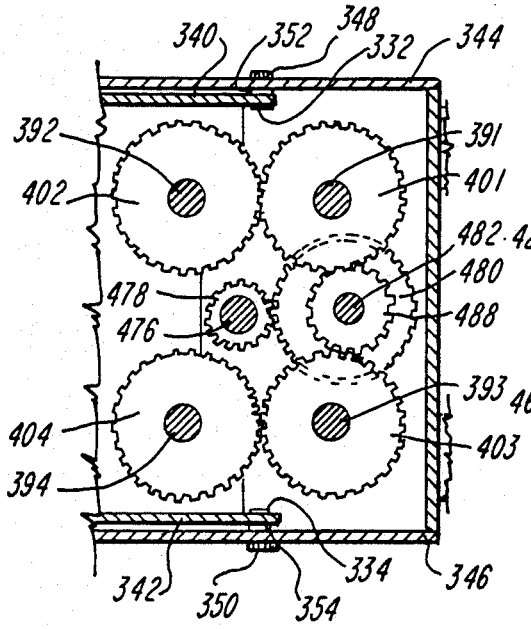
FIG. 24 is a cross sectional view taken along the lines 24—24 of FIG. 19.
Figure 25:
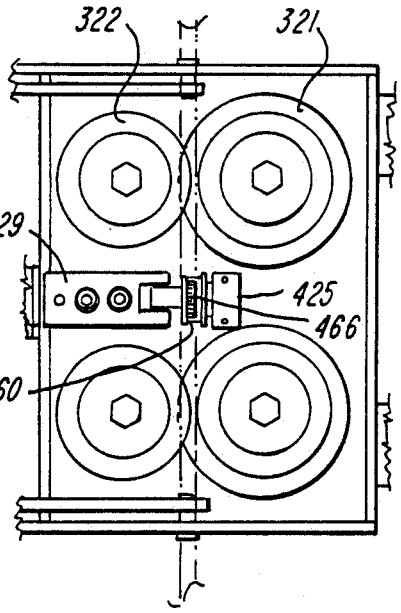
FIG. 25 is a bottom plan view taken along the lines 25—25 of FIG. 19.

Seaming rollers 321, 323 and 325 are rotatably mounted on a main base portion 329 and rollers 322, 324 and 326 are rotatably mounted on a movable base portion 30. Movable base 330 is pivotally connected to main base 329 by two main hinge pins 332 and 334 which are located at opposite ends of seamer 310 as best illustrated in FIG. 24. Pins 332 and 334 are axially aligned and the imaginary axis which passes through them is identified by the letter P1. As with axis P of seamer 10, the location of axis P' is important for maintaining constant drive gear engagement which will be discussed in more detail below.

Referring now to FIG. 24, pins 332 and 334 are each rotatably mounted in bushings (not shown) which, in turn, are mounted in selectively located holes provided in end plates 340 and 342 of the movable base and end plates 344 and 346 of the main base. Each pin is provided with a head which abuts up against an inwardly facing surface of its respective movable base end plate. Pins 332 and 334 are secured in place, respectively, by conventional nut and washer assemblies 348 and 350 which are threaded onto the ends of the pins extending outwardly from the exterior surfaces of the respective main base end plates. Collar-like spacers 352 and 354 are also mounted on each pin's shaft between the respective movable and main base end plates to prevent the plates from rubbing against each other during pivotal movement of movable base 330.

Figure 17:
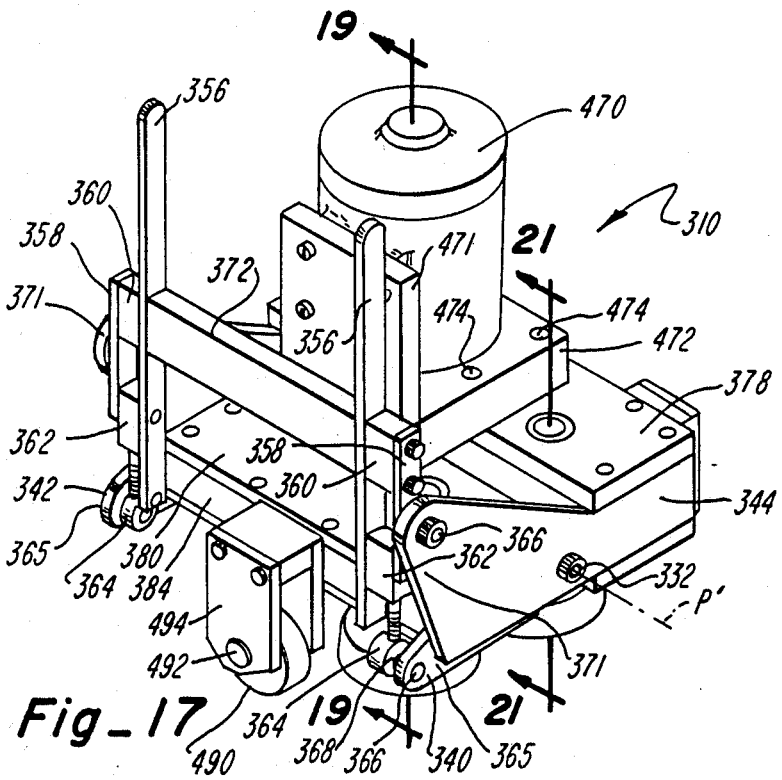
FIG. 17 is a perspective view of another form of seaming apparatus embodying features of the present invention illustrated in its operating position.
Figure 18:
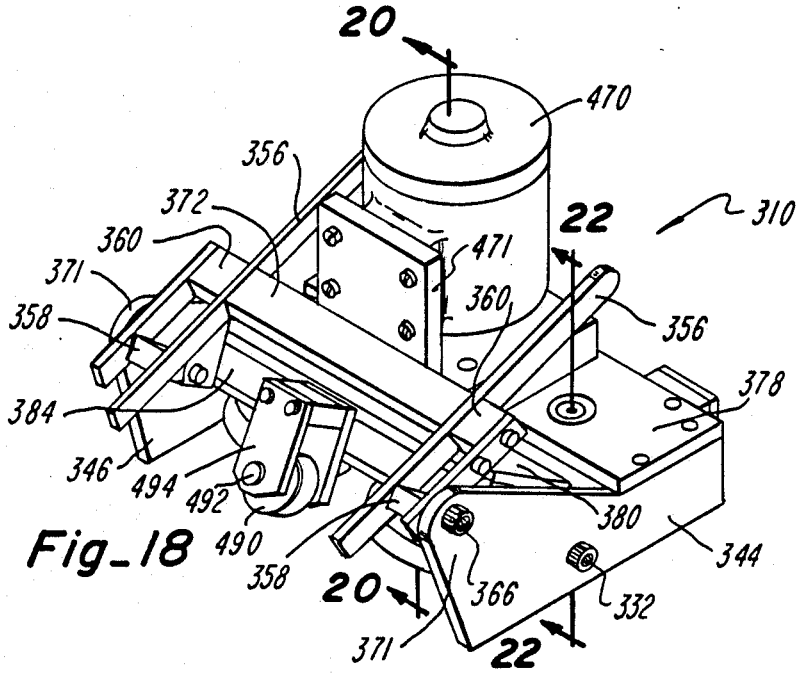
FIG. 18 is a perspective view of the seaming apparatus of FIG. 17 illustrating the apparatus in the spread position.

Pivotal movement of base 330 between a first operating or seaming position and a second, spread or release position is provided by an actuating means or lift assembly which is similar to that of seamer 10. The actuating means includes a rigidly connected parallel pair of right and left lever arms 356. The right lever arm as viewed in FIGS. 17 and 18 is rigidly bolted to a side bar 358 via a spacer block 360. Lever arm 356 and side bar 358 are pivotally connected at P12 to a movable link 362 having a threaded rod end 364. Rod end 364 is pivotally connected at P13 to an angled extension 365 of movable base end plate 340 by a pivoting bolt means 366. Bolt means 366 is also provided with a collar-like spacer 368 which is mounted on the bolt's shaft. The spacer facilitates alignment of the pivoting lever's components. Another pivoting bolt means 370 is provided to pivotally connect side bar 358 to an angled extension 371 of main base end plate 344 at P11. The right lever arm is rigidly attached to the left lever arm by a common spacer arm 372 which is bolted to lever arm 356 at its respective ends. Left arm 356 and movable link 362 employ components which are identical to those of the right arm and link and, as such, are identically numbered. In addition, movable base end plate 342 has an extension 365 and movable base end plate 346 has an extension 371. Extensions 365 are similar to extensions 62 and 63 of seamer 10 and extensions 371 are similar to extensions 54 and 55 of seamer 10.

FIGS. 17 and 19 illustrate seamer 310 in its first, operating or seaming position. Lever arms 356 and associated movable links 362 are generally end to end at a slight over-center position toward the base with the lower end portion of arm 356 being positioned against a side plate of the movable base at a contact point C' again located slightly below the pivot point P'. As with seamer 10, this position serves to lock the movable base against lateral movement.

Figure 20:
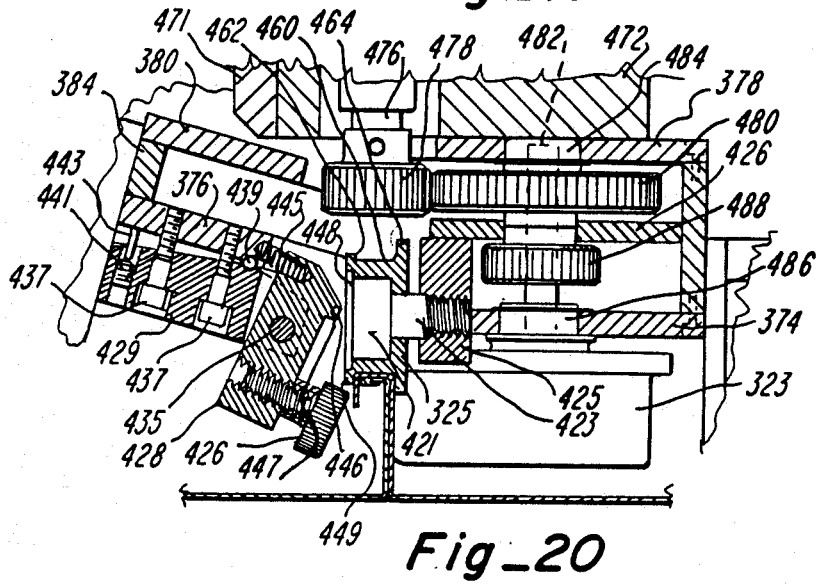
FIG. 20 is a cross sectional view taken along the lines 20—20 of FIG. 18 with the building panels shown unseamed.
Figure 22:
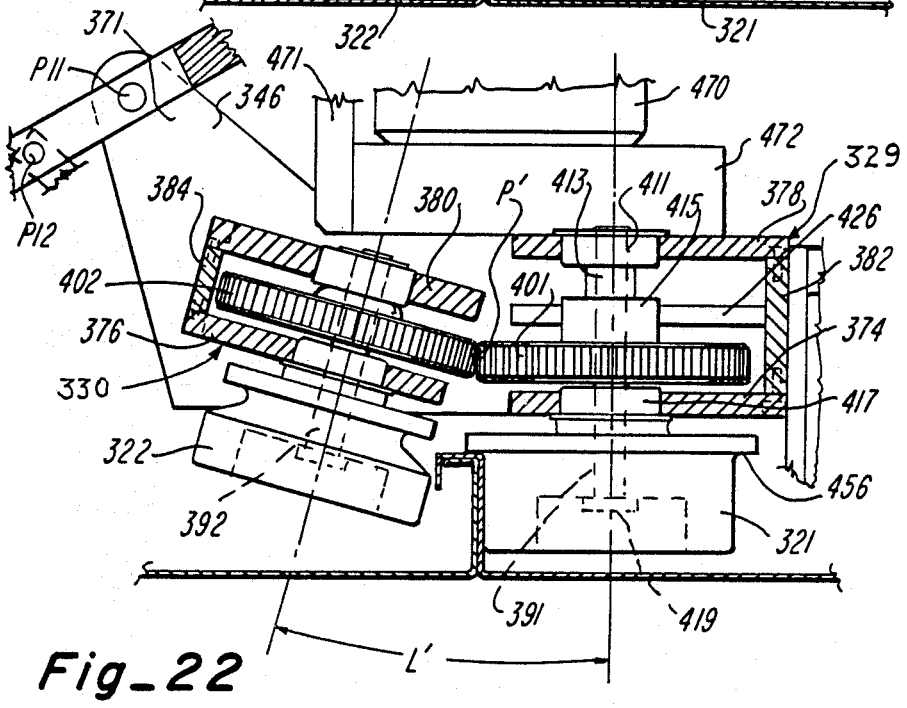
FIG. 22 is a cross sectional view taken along the lines 22—22 of FIG. 18 with the building panels shown unseamed.

FIGS. 18, 20 and 22 illustrate seamer 310 in its second spread position. To put seamer 310 in this position, lever arms 356 are pulled inwardly and downwardly, i.e. in a clockwise direction as viewed in the Figures from the over-center position toward axis P' passing through hinge pins 332 and 334. As with seamer 10, this action moves pivot P12 away from the seamer past the over-center position. As the lever arms continue to pivot about P12, links 362 pull upwardly on lower extensions 365 of the movable base end plates, thereby raising the movable base to an open or spread position. As such, the movable base and associated rollers will have rotated through an included angle L' which is illustrated in FIG. 22. This movement is sufficient to enable the now spread rollers to clear the unseamed flange sections 15 and 17 of the nested side edge portions so the seamer can be set down upon adjacent side panels to be seamed or lifted off a seam having already been seamed. As with included angle L of seamer 10, included angle L' is about 20 degrees and would not normally exceed 30 degrees.

Referring now to FIGS. 21 and 22, main base 329 and pivotally movable base 330, respectively, include bottom plates 374 and 376, top plates 378 and 380 and side plates 382 and 384. Seaming rollers 321 and 323 are rotatably mounted on main base 329 in the same manner on shafts 391 and 393, respectively, which in turn carry drive gears 401 and 403, respectively. Similarly, seaming rollers 322 and 324 are rotatably mounted on pivotal base 330 in the same manner on shafts 392 and 394, respectively, which, in turn, carry drive gears 402 and 404.

Since the mounting of rollers 321 and 323 on the main base is identical, only the mounting of roller 321 will be described. Roller 321 is affixed at its upper section to the inside race of a bearing 411 with the outer race of the bearing mounted in top plate 378. Drive gear 401 is conventionally affixed to the shaft's center section with a key (not shown) in a key way (also not shown) provided in the shaft's center section. Shaft 391's upper mid-section has a shoulder 413 and a spacer 415 mounted thereon which serve to space drive gear 401 from the main base's top plate 378. The lower mid-section of shaft 391 is affixed to the inside race of a bearing 417 with the outer race of the bearing mounted in bottom plate 374. The lowermost section of shaft 391 extends downwardly through and below bottom plate 374 and has drive roller 321 mounted thereon. Drive roller 321 is provided with an axially extending bore which receives shaft 391 and is conventionally secured thereto with a key (not shown) in a key way (also not shown) provided in shaft 391. The axially extending bore of roller 321 extends through the roller and the bore is sized to receive a conventional washer and threaded bolt assembly 419 which threads into an internally threaded hole provided in the bottom of shaft 391 to rigidly secure the roller to the shaft.

The mounting of rollers 322 and 324 on pivotally movable base 330 is identical to that described above for roller 321 with the exception that no shoulders and spacers (such as shoulders 413 and spacers 415) are employed since the movable base's top and bottom plates are located closer to one another than those of the main base.

Figure 23:
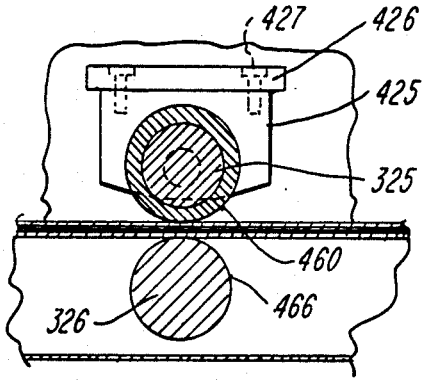
FIG. 23 is a fragmentary cross sectional view taken along the lines 23—23 of FIG. 19.

FIGS. 19, 20 and 23 illustrate the mounting of the third or center set of rollers 325 and 326. The axes of these rollers are generally horizontally disposed so that the rollers engage the nested side edge portions from the top and bottom, respectively. This is in contrast to the rollers of the first and second sets which preferably have vertically disposed axes and, as such, engage or approach the nested side edge portions from their opposite sides. The center rollers are also distinguishable in that they are freely rotating (i.e. they are not power driven through a gear train drive system as are the rollers of the first and second sets).

As previously mentioned, top center roller 325 is rotatably mounted on base portion 329 between the first and second set of rollers. Rotatable mounting is provided by rigidly mounting roller 325 to the outside race of a bearing 421 which, in turn, is rotatably mounted on its inside race to the end of a shaft 423. The other end of shaft 423 is rigidly secured to a support block 425 by threading engagement therewith. Support block 425, in turn, is rigidly attached to a center plate 426 of the main base by bolts 427 as seen in FIG. 23.

Bottom center roller 326 is rotatably and adjustably mounted on pivotally movable base 330 via a pivoting cam arm 428 and an adjustable rocker arm 429. Rotatable mounting is provided by rigidly mounting roller 326 to the outer race of a bearing 431. The inner race of bearing 431 is rotatably mounted on the end of a shaft 433 which, in turn, is rigidly secured to cam arm 428 by threading engagement therewith. Cam arm 428 is pivotally secured to rocker arm 429 by a pivot pin 435 which is received in selectively located bores provided in the opposing surfaces of the rocker arm and cam arm. Rocker arm 429 is rigidly secured to the movable base's bottom plate 376 by two threaded bolts 437. Pivotal adjustment of the rocker arm is provided by a cylindrically shaped rocker pin 439 which is horizontally disposed in complementary shaped opposing grooves which are provided in the opposing surfaces of the rocker arm and bottom plate 376. The angle at which rocker arm 429 is secured about rocker pin 439 is set by a threaded swivel screw clamp 441 which as illustrated in FIGS. 19 and 21 is threadably received in a threaded bore provided in the left side of the rocker arm. The upper end of screw clamp 441 impinges against the bottom of a shaft-like extension 443 which extends out from the bottom surface of bottom plate 376. By turning screw clamp 441 (with a screw driver or similar tool) after loosening bolt means 437, screw clamp 441 can be moved upwardly or downwardly within its threaded bore. Such movement will adjust the angle of the rocker arm about the rocker pin which, in turn, will raise or lower the cam arm and bottom roller 326. By lowering bottom roller 326, heavier gauge metal can be accomodated by rollers 325 and 326. Similarly, by raising roller 326 lighter gauge metal can be accomodated. After setting swivel clamp 441 to accomodate a particular gauge of metal, bolt means 437 should be tightened to maintain clamp 441 in the desired position.

A compression spring 445 is also mounted in axially aligned bores provided in the opposing portions of the end of bottom plate 376 and cam arm 427. Compression spring 445 serves to push a cam surface 446 of a nose portion 447 of the cam arm up against an end surface 448 of shaft 423. When the movable base portion is pivoted to the spread position, compression spring 445 causes the cam arm to pivot (in a clockwise direction as seen in FIGS. 19 and 20) about its pivot 435 which, in turn, causes cam surface 446 to move downwardly along end surface 448, thereby enabling roller 326 to move down and out to clear lip 449 on roller 325 and out from under its vertically disposed seaming position illustrated in FIG. 19. Conversely when the movable base portion is pivoted back to the seaming position the roller 326 is moved in and up by means of the particular shape of the cam surface 446 so as to form the seam as shown in FIG. 19. This seam may be referred to as a single fold or single lock seam. The compression spring similarly enables roller 326 to clear lip 449 when the roller is moved into its operating position. After clearing lip 449, further movement of the movable base towards the operating position causes cam surface 446 of nose 447 to move upwardly along end surface 448 until roller 326 is firmly secured in its final vertical seaming position illustrated in FIG. 19.

FIGS. 21 and 19 illustrate, respectively, the two sequential seaming operations provided by seamer 310 of the present invention. FIG. 15, as previously mentioned, illustrates the unseamed channel provided by the nested side edge portions as it would appear prior to being seamed.

FIG. 21 illustrates drive rollers 321 and 322 engaging the outwardly facing surfaces of sections 16, 18 and 17, respectively, of the nested side edge portions and bending terminal end section 18 inwardly approximately 45 degrees from its initial vertical downwardly extending position which is illustrated in FIG. 15. The 45 degree bend is made by an upper 45 degree beveled surface 450 of roller 322 as it travels along the channel. The initial bending of terminal section 18 can also be made by closing or clamping the pivotally movable base portion 330 about the unseamed channel (i.e. by moving base 330 from its second spaced position as illustrated in FIG. 22 to its first or seaming position illustrated in FIG. 21). This closing movement in effect clamps the nested side edge portions together and positions the respective peripheral surfaces of the rollers against the appropriate outwardly facing surfaces of the nested side edges so that the rollers will properly track on the nested side edges to provide the desired finished seam. Buckling of the nested side edges is prevented by vertical surfaces 452 and 454 of rollers 321 and 322, respectively, and a horizontal upper lip surface 456 of roller 321.

FIG. 19 illustrates the second and final forming operation provided by seamer 310. As previously mentioned, center rollers 325 and 326 engage the bent seam provided by the first seaming operation from the seam's top and bottom to bend the already 45 degree bent terminal end section to its final position illustrated in FIG. 19 wherein it is bent under and up against the inturned lateral flange section 15 of the nested side edge portions. To provide such a bend, roller 325 is provided with a generally cylindrical, horizontally disposed inner peripheral surface 460 and a pair of vertically extending lip surfaces 462 and 464 which respectively extend upwardly from opposite sides of inner surface 460. These surfaces receive the outwardly facing lateral flange section 17 of the nested side edges and the adjoining side sections of sections 16 and 18 and restrain them from buckling as the cylindrical, horizontally disposed peripheral surface of roller 326 (i.e. surface 466) engages the 45 degree bent terminal section 18 and bends it tightly up against lateral flange section 15, thereby providing the finished seam. Lip surfaces 462 and 464 of roller 325 also facilitate proper tracking of seamer 310 along the channel provided by the nested side edges.

The drive for the first and second sets of rollers includes a reversible electric motor 470 mounted to a side plate 471 and a bottom motor mount plate 472. Motor mount plate 472 is bolted to main base portion 329 by conventional bolts 474 as illustrated in FIGS. 17 and 18. Motor 470 is provided with a drive shaft 476 (FIG. 24) which has a main drive gear 478 mounted thereon at the shaft's lower end. Main drive gear 478 meshes with a main cluster gear 480 mounted on a cluster gear shaft 482 which is rotatably mounted on main base 329 by bearings 484 and 486 in a manner similar to that for mounting drive shaft 329 as previously described. Cluster gear shaft 482 also has an auxiliary cluster gear 488 rigidly mounted on it below the main cluster gear. Auxiliary gear 488 meshes with gears 401 and 403 to transmit power to seaming rollers 321 and 323, respectively. Gears 401 and 403, in turn, mesh respectively with gears 402 and 404 to transmit power to rollers 322 and 324 respectively.

As with the drive gears of seamer 10, seamer 310's drive gears (i.e. for the first and second set of seaming rollers) are maintained in constant meshing engagement with each other, including not only when movable base 330 is in its first operating position but also when it is in its second or spaced position and also when being pivotally moved therebetween. Accordingly, grinding and stripping of seamer 310's drive gears are also reduced.

Drive gear engagement is maintained by selectively locating the axially aligned hinge pins 332 and 334 in selectively located holes provided in the main and movable base end plates so that the hinge pin's imaginary axis P' passes through the meshing teeth of the drive gears at a location near the upper facing horizontal surface of the meshing drive gears. This location is virtually identical to that of seamer 10 which is illustrated in FIGS. 7–9.

Seaming apparatus 310 is also provided with three freely rotating skate wheels 490, two of which are mounted to main base 329 with the remaining skate wheel mounted to movable base 330. Each skate wheel is mounted on an axle 492 which is mounted for rotational movement in a bracket 494. Each bracket 494 is conventionally bolted to its respective base portion at the locations illustrated in the drawings. The skate wheels space the seaming apparatus from the surfaces of the adjacent panels to facilitate proper tracking of the seamer along the nested side edge portions of the adjacent panels.

OPERATION

Seaming with seamer 310 can be initiated at any point along the unseamed inverted channel provided by the nested side edge portions of the adjacent panels. In addition, since motor 470 is reversible, seamer 310's direction of movement along the channel can be reversed without having to turn the seamer around (i.e. without having to lift the seamer off the channel).

To seam with seamer 310, the seamer's movable base 330 is preferably first pivotally moved or opened to its second or spaced position as illustrated in FIGS. 20 and 22. This allows the first, second and third or center set of rollers to be positioned down over the channel at any point along the channel. Movable base 330 is then moved to its first or operating position which causes the first and second sets of rollers to clampingly engage oppositely facing surfaces of the channel and bend the channel's terminal section 18 inwardly approximately 45 degrees as illustrated in FIG. 21. While the first and second sets of rollers are bending the terminal end section 45 degrees, the vertically disposed center set of rollers (i.e. rollers 325 and 326) is bending another portion of the terminal section a full 90 degrees to provide a finished seam at this point on the channel as illustrated in FIG. 19. Motor 470 is then started causing the first and second sets of rollers to rotate and begin moving the seamer along the channel. As previously mentioned, when seamer 310 begins moving, the leading set of rollers (i.e. either the first or second set whichever is leading) bends the terminal section 45 degrees. The third or center set of rollers which rotates freely then receives the 45 degree bend made by the leading set of rollers and bends it another 45 degrees to provide the finished seam. The trailing set of rollers which receives the finished seam does not bend the finished seam. However, it does track on the seam and thereby aid in moving the seamer along the channel.

Although the present invention has been described with a certain degree of particularity, it should be understood that the present disclosure has been made by way of example and that changes in details of structure may be made without departing from the spirit thereof.

What is claimed is:

1. Seaming apparatus for joining together adjacent side edge portions of two adjacent panels to form a connecting seam, said seaming apparatus comprising:

a first set and a second set of opposed seaming rollers rotatably mounted on a base including a first base portion and a second base portion, said opposed rollers of each set having peripheral surface portions arranged to bear against differently facing surfaces of the side edge portions of two adjacent panels, said sets being spaced from one another along said base portions to engage and track on said side edge portions so as to form a connecting seam as said rollers are moved along said side edge portions, one roller of each set being supported on said first base portion, said second base portion supporting the other roller of each set, said first and second base portions being joined for pivotal movement between a first position for seaming and a second position in which the rollers of each set are spread apart from each other;

actuating means for moving said base portions between said positions; and drive means for rotating at least one set of said rollers to move said rollers and said supporting means along the side edge portions, said drive means including a drive gear for each roller of each set of rollers to be driven by said drive means, said drive gears of a set meshing with each other when said base portions are in either of the first and second positions and during movement between the positions.

2. Seaming apparatus for joining together adjacent outturned and inturned side edge portions of two adjacent panels to form a continuous connecting seam, the outturned side edge portion including an upstanding side section, outturned lateral flange sections and a downturned terminal section forming an exterior inverted channel prior to seaming, the inturned side edge portion being nested or disposed within said outturned side edge portion and including an upstanding side section and an inturned lateral flange section extending along said outturned lateral flange section, said seaming apparatus comprising:

two sets of opposed seaming rollers rotatably mounted on a supporting means including a first base portion and a second base portion, the opposed rollers of each set having peripheral surface portions arranged to simultaneously bear against differently facing surface portions of at least one of said nested side edge portions, said sets being spaced from one another along said base portions to successively engage the nested side edge portions and to track thereon so as to at least bend said terminal section back under said inturned lateral flange section to form a continuous connecting seam as said rollers are moved along the nested side edge portions, one roller of each set being supported on said first base portion, said second base portion supporting the other roller of each said set, said first and second base portions being joined for guided pivotal movement toward and away from one another between a first position for seaming and a second position in which the rollers of each set are spread apart from each other;

actuating means for pivotally moving said base portions between said positions; and drive means for simultaneously rotating the rollers of at least one set of opposed seaming rollers to move said rollers and said supporting means along the inverted channel provided by the nested side edge portions, said drive means including a shaft having a drive gear mounted thereon for each roller of a set of rollers to be driven by said drive means, said drive gears of a set engaging or meshing with each other and remaining engaged or meshed when said base portions are in said first and second positions and during pivotal movement therebetween.

3. Seaming apparatus as claimed in claim 1 wherein said movement between said positions is about an axis which passes through the meshing teeth of the drive gears for each set of rollers so that the gears remain engaged.

4. Seaming apparatus as set forth in claim 1 wherein the axes of the rollers of each set are substantially parallel in said first position and in said second position the axes of the rollers of each set are at an included angle of less than about 30 degrees.

5. Seaming apparatus as set forth in claim 1 wherein said drive means includes a motor mounted on said supporting means and a gear train transmitting power from the motor to four sets of opposed seaming rollers, said gear train including said continually meshing drive gears, a main drive gear, four chain sprockets and two roller chains, said main gear meshing with one drive gear of each of the first and second roller sets, each of said drive gears meshing with its associated drive gear for the other roller of its respective set of opposed seaming rollers, said other roller of the first set having the first chain sprocket mounted on its shaft, said first chain sprocket meshing with the first roller chain which, in turn, meshes with the second chain sprocket mounted on the shaft of a roller of the third set of opposed seaming rollers, the drive gear for the latter roller meshing with the drive gear of the other roller of the third set of opposed seaming rollers, the other roller of the second set having the third chain sprocket mounted on its shaft, said third chain sprocket meshing with the second chain roller which, in turn, meshes with the fourth chain sprocket mounted the shaft of a roller of the fourth set of rollers, the drive gear of the latter roller of the fourth set meshing with the drive gear of the other roller of the fourth set.

6. Seaming apparatus as set forth in claim 2 wherein the spacing between each of said sets of rollers in said second position is sufficient to permit said sets of rollers to be placed down on any point along the unseamed inverted channel provided by the nested side edge portions or any point along the formed continuous seam and also be lifted up and removed from any point along the inverted channel or the formed continuous seam.

7. Seaming apparatus as claimed in claim 2 wherein said apparatus is bi-directional such that said apparatus is capable of forming said seam when moved in either direction along the inverted channel provided by the nested side edge portions.

8. Seaming apparatus for joining the side edge portions of two adjacent panels to provide a continuous seam, one panel having an outturned side edge portion including a terminal side section and the other panel having an inturned side edge portion nested in said outturned side edge portion, said seaming apparatus comprising:

a base including a main base portion and a movable base portion, said movable base portion being pivotally connected to said main base portion for pivotal movement about an axis between a first position for seaming and a second position in which the rollers of each set are spread apart;

a leading set of motor driven seaming rollers and a trailing set of motor driven seaming rollers mounted on said base, said rollers of each set having peripheral surfaces arranged to engage the nested side edge portions of said adjacent panels, the rollers of each set being oppositely disposed, one roller of each set being rotatably mounted on said movable base portion, the other roller of each set being rotatably mounted on said main base portion;

a drive motor mounted on said base, said drive motor rotating said motor driven rollers through a power transmission train coupled between said motor and said rollers which moves said apparatus along the nested side edge portions of the panels;

actuating means for pivotally moving the rollers mounted on the movable base portion toward and away from those mounted on the main base about said axis between said first operating position and said second spaced position, the axes of the rollers of each set of driven rollers being substantially parallel in said first position and forming an included angle of less than about 30 degrees in said second position, said driven seaming rollers being engaged by said drive motor when the movable base is in the first operating position, the second spaced position and when it is pivotally moved therebetween.

9. Seaming apparatus as claimed in claim 1 wherein each of said rollers is mounted on a shaft which is rotatably mounted on a bearing which, in turn, is mounted in said supporting means, said shaft having a driven gear affixed thereto between its top and bottom ends, the roller being affixed at the bottom of the shaft.

10. Seaming apparatus as claimed in claim 1 wherein said drive means includes a reversible motor mounted on said supporting means and a gear train transmitting power from the motor to said rollers, said gear train including a main drive gear which meshes with a drive gear of at least one set of drive gears for driving a set of opposed seaming rollers.

11. Seaming apparatus as claimed in claim 1 wherein said first base portion has a pair of first end plates secured at opposite ends to the first base portion, each of said first end plates being provided with a first bore, said first bores being in axial alignment with each other, said second base portion having a pair of second end plates secured at opposite ends of said second base portion and being adjacent said first end plates, each of said second end plates being provided with a second bore, said second bores being in axial alignment with each other, the first and second bores being axially aligned by a pair of pivot pins, each of which extends through an adjacent pair of said first and second bores, said pins being freely rotatable in said bores so as to facilitate pivotal movement of said first and second base portions toward and away from one another between said first and second positions.

12. Seaming apparatus as claimed in claim 1 wherein said actuating means is pivotally mounted to the first and second base portions which locates the actuating means off to one side of the second base portion, said actuating means including a pair of movable links and a pair of lever arms which are rigidly connected by a common spacer bar, each lever arm being pivotally connected at an end thereof to an end of one of the movable links, each of said lever arms also being pivotally connected between its ends to an extension of the first base portion, each of said movable links being pivotally connected at its other end to an extension of the second base portion, said pivotal connections being such that said actuating means is capable of being moved between two positions to pivotally move said base portions between said first and second positions.

13. Seaming apparatus as claimed in claim 12 wherein each said movable link includes a clevis and a threaded rod end, said rod end being in threaded engagement with said clevis, said clevis being pivotally connected to one end of an associated lever arm, said rod end being pivotally connected to said second base portion, said threaded engagement of said clevis and rod end enabling the length of the movable link to be adjusted so as to vary the spacing between each set of rollers.

14. Seaming apparatus as claimed in claim 1 which is reversible and includes a third set of opposed seaming rollers disposed between the first and second sets of opposed seaming rollers and being movable therewith, said third set of rollers providing the final bending operation to the adjacent side edge portions which produces the connecting seam, said first and second sets of rollers serving as either the leading or trailing set of rollers depending on the seaming apparatus' direction of movement along the adjacent side edge portions, said trailing set of rollers receiving and tracking on said continuous seam produced by the leading set of rollers but performing no forming operation thereon.

15. Seaming apparatus as recited in claim 14 wherein when seaming together horizontally disposed panels, the axes of said first and second rollers will be substantially parallel and vertically oriented and the axes of said third set of rollers will be substantially parallel but horizontally oriented.

16. Seaming apparatus as claimed in claim 14 wherein the rollers of the third set rotate freely as the seaming apparatus moves along the adjacent side edge portions of the adjacent panels, said rollers of the third set not being driven by said drive means.

17. Seaming apparatus as claimed in claim 1 wherein the mounting of one of said set of opposed seaming rollers includes a cam arm with a cam surface of a particular shape which moves one of the third rollers in a selected path to aid in separating the roller from its associated roller of said one set when said base portions are moved from the first operating position to the second spread position, said separating thereby serving to space the rollers of said one set when the base portions are in the second position so that the seaming apparatus is capable of being placed down over any point along the unseamed adjacent side edge portions of the adjacent panels and lifted off any point along the seam after said seaming.

* * * * *